US010909782B1

(12) United States Patent
Natanzon

(10) Patent No.: US 10,909,782 B1
(45) Date of Patent: Feb. 2, 2021

(54) DATA MANAGEMENT FOR VEHICLE EVENT DATA RECORDER

(71) Applicant: EMC IP Holding Company LLC, Hopkinton, MA (US)

(72) Inventor: Assaf Natanzon, Tel Aviv (IL)

(73) Assignee: EMC IP Holding Company LLC, Hopkinton, MA (US)

( * ) Notice: Subject to any disclaimer, the term of this patent is extended or adjusted under 35 U.S.C. 154(b) by 302 days.

(21) Appl. No.: 15/896,635

(22) Filed: Feb. 14, 2018

(51) Int. Cl.
*G07C 5/08* (2006.01)

(52) U.S. Cl.
CPC ..... *G07C 5/0841* (2013.01); *G07C 5/0808* (2013.01)

(58) Field of Classification Search
None
See application file for complete search history.

(56) References Cited

U.S. PATENT DOCUMENTS 6,246,933 B1 * 6/2001 Bague ..... G07C 5/085 340/438
8,014,917 B2 * 9/2011 Hagenbuch ..... G07C 5/008 701/32.2
8,374,746 B2 * 2/2013 Plante ..... H04N 21/23406 701/32.2
2007/0219686 A1 * 9/2007 Plante ..... H04N 5/23229 701/33.4
2009/0157255 A1 * 6/2009 Plante ..... G06Q 10/00 701/33.4
2015/0088335 A1 * 3/2015 Lambert ..... H04L 67/10 701/1
2016/0269491 A1 * 9/2016 Eom ..... G06T 11/001
2016/0350298 A1 * 12/2016 Ono ..... G06F 21/6209
2017/0113664 A1 * 4/2017 Nix ..... G07C 5/0841
2019/0140778 A1 * 5/2019 Kishikawa ..... H04L 1/0091
2019/0220011 A1 * 7/2019 Della Penna ..... G08G 1/0133

OTHER PUBLICATIONS

Tom Simonite, "Intelligent Machines: Tesla Knows When a Crash is Your Fault, and Other Carmakers Soon Will, Too," https://www.technologyreview.com/s/601657/tesla-knows-when-a-crash-is-your-fault-and-other-carmakers-soon-will-too/, Jun. 8, 2016.

* cited by examiner

*Primary Examiner* — David P. Merlino
(74) *Attorney, Agent, or Firm* — Ryan, Mason & Lewis, LLP

(57) ABSTRACT

In an information processing system comprising at least one vehicle wherein the at least one vehicle comprises an event data recorder and a data management module resident in the at least one vehicle, a method records a plurality of data elements in the event data recorder, and evaluates each of the plurality of data elements to determine which of the plurality of data elements to maintain in a memory region of the event data recorder and which of the plurality of data elements to delete from the memory region of the event data recorder.

20 Claims, 3 Drawing Sheets

300

| 301 | 303 | 305 |
|---|---|---|
| 1 | CRITICAL DATA | BACKED UP |
| 2 | CRITICAL DATA | NOT PROTECTED |
| 3 | IMPORTANT DATA | NOT PROTECTED |
| 6 | IMPORTANT DATA | NOT PROTECTED |
| 8 | NICE TO HAVE DATA | NOT PROTECTED |
| 11 | IMPORTANT DATA | NOT PROTECTED |

DATA MANAGEMENT FOR VEHICLE EVENT DATA RECORDER

FIELD

The field relates generally to information processing systems, and more particularly to a data management system for managing storage and maintenance of vehicle event data recorder (EDR) data.

BACKGROUND

Today, drivers and environmental factors are more likely to be blamed for vehicle accidents than vehicle manufacturers (or suppliers to those manufacturers). However, with the advent of autonomous (e.g., driverless, self-driving) and semi-autonomous vehicles, and the correspondingly reduced role of drivers, questions regarding the causes and the search for explanations of accidents will inevitably move beyond the human to encompass the machine. Consequently, manufacturers have a continued incentive to demonstrate the safety of their product. Enhanced event data recorders (EDRs) provide a means for manufacturers to increase the safety of their vehicles.

More than 90 percent of cars utilize some form of EDR, and recent National Highway Traffic Safety Administration (NHTSA) regulations are increasing that trend by requiring an EDR in new cars and setting mandatory standards for the type of data EDRs must capture. EDRs were originally installed in vehicles in the 1990s to analyze airbag activation, recording when and whether airbags deployed. Over time, as with airplanes, EDRs have been used as just one of many data points in accident reconstruction.

An EDR typically records data in a continuous loop in temporary memory, writing over the data every five or more seconds until an accident event (e.g., airbag deployment) occurs. At that point, data from a certain period (typically seconds) before the accident is recorded into permanent memory, which can be retrieved and analyzed. The recorded data has traditionally contained basic information related to, for example, airbag deployment, such as car speed, seatbelt usage, status of the car brakes, engine RPMs and time between crash impact and airbag deployment. More recently, the NHTSA created standards for EDR data, requiring 15 data points and certain accuracy ranges for each.

SUMMARY

Illustrative embodiments provide a context and risk based data management system for vehicle EDR data. Embodiments of the present invention advantageously provide intelligent decision-making on what data to keep in EDR storage, based on a determined importance of the data and whether the data is related to or will contribute to vehicle events. Data management decisions in embodiments of the present invention are the result of a risk-based analysis, which prioritizes and maintains data associated with risk to the vehicle. Embodiments of the present invention further advantageously utilize networking capabilities to provide storage and/or replication of EDR data at a remote storage platform, and provide for management of data based on whether or not data was replicated.

For example, in one illustrative embodiment, a method comprises the following steps. In an information processing system comprising at least one vehicle wherein the at least one vehicle comprises an event data recorder and a data management module resident in the at least one vehicle, a method records a plurality of data elements in the event data recorder, and evaluates each of the plurality of data elements to determine which of the plurality of data elements to maintain in a memory region of the event data recorder and which of the plurality of data elements to delete from the memory region of the event data recorder.

These and other illustrative embodiments include, without limitation, apparatus, systems, methods and computer program products comprising processor-readable storage media.

DETAILED DESCRIPTION

Figure 1:
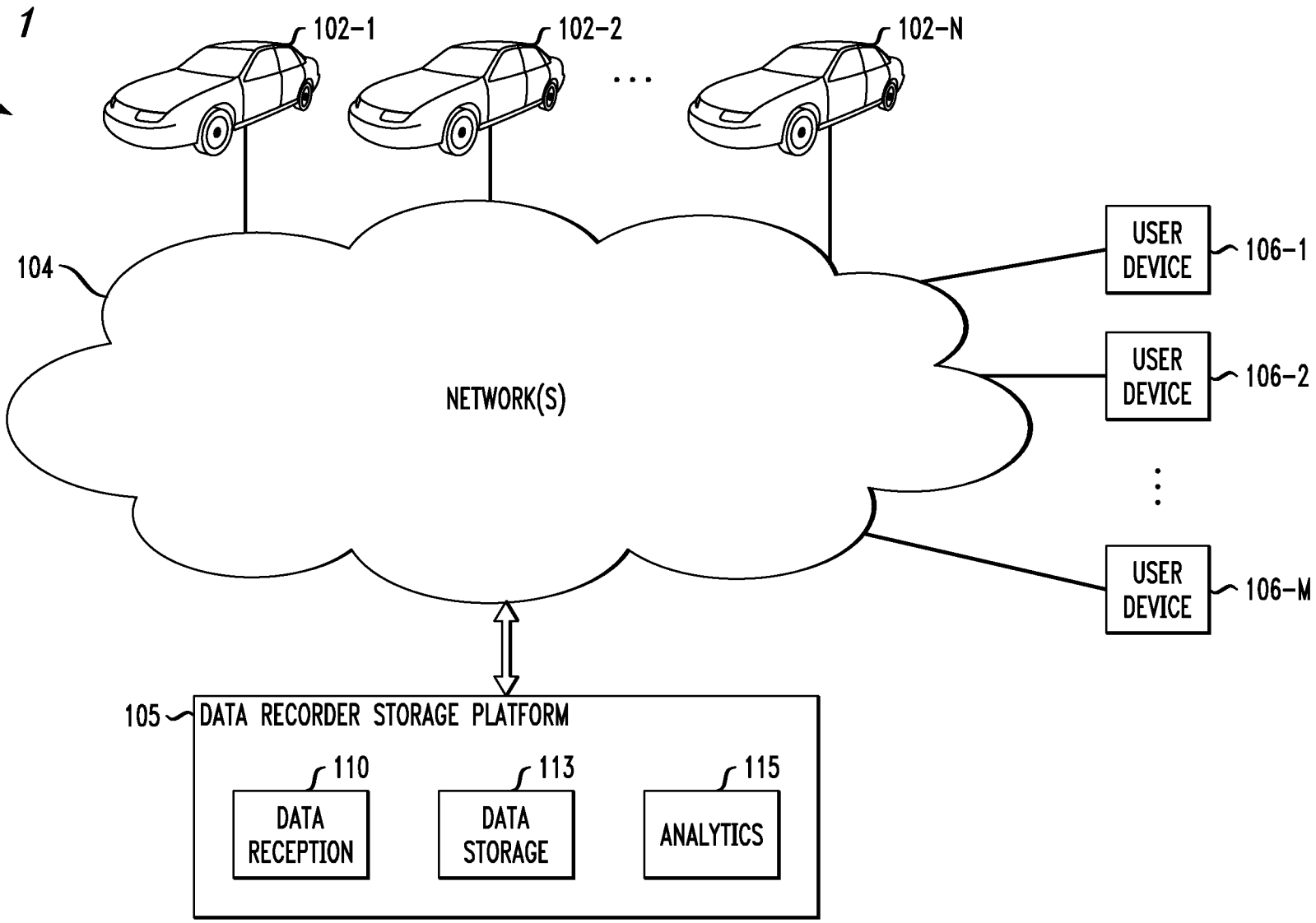
FIG. 1 is a block diagram of an information processing system comprising a data recorder storage platform in an illustrative embodiment.

Illustrative embodiments will be described herein with reference to exemplary information processing systems and associated computers, servers, storage devices and other processing devices. It is to be appreciated, however, that these and other embodiments are not restricted to the particular illustrative system and device configurations shown. Accordingly, the term "information processing system" as used herein is intended to be broadly construed, so as to encompass, for example, processing systems comprising cloud computing and storage systems, as well as other types of processing systems comprising various combinations of physical and virtual processing resources. An information processing system may therefore comprise, for example, at least one data center or other cloud-based system that includes one or more clouds hosting multiple tenants that share cloud resources. Such systems are considered examples of what are more generally referred to herein as cloud-based computing environments. Some cloud infrastructures are within the exclusive control and management of a given enterprise, and therefore are considered "private clouds." The term "enterprise" as used herein is intended to be broadly construed, and may comprise, for example, one or more businesses, one or more corporations or any other one or more entities, groups, or organizations. An "entity" as illustratively used herein may be a person or system. On the other hand, cloud infrastructures that are used by multiple enterprises, and not necessarily controlled or managed by any of the multiple enterprises but rather are respectively controlled and managed by third-party cloud providers, are typically considered "public clouds." Examples of public clouds may include, but are not limited to, Amazon Web Services® (AWS), Google Compute Engine® (GCE), and Windows Azure® Services platforms. Thus, enterprises can choose to host their applications or services on private clouds, public clouds, and/or a combination of private and public clouds (hybrid clouds) with a vast array of computing resources attached to or otherwise a part of the infrastructure. Numerous other types of enterprise computing and storage systems are also encompassed by the term "information processing system" as that term is broadly used herein.

As used herein, "real-time" refers to output within strict time constraints. Real-time output can be understood to be instantaneous or on the order of milliseconds or microseconds. Real-time output can occur when the connections with a network are continuous and a user device receives messages without any significant time delay. Of course, it should be understood that depending on the particular temporal nature of the system in which an embodiment of the invention is implemented, other appropriate timescales that provide at least contemporaneous performance and output can be achieved.

As used herein, a "vehicle" or "ground vehicle" refer to, for example, automobiles, including sport utility vehicles, mini vans and sedans, pick-up trucks, buses, and trucks. Embodiments of the present invention are applicable to different types of ground vehicles, and are not necessarily limited to cars.

Autonomous vehicles (AVs) have the potential to change the transportation landscape through increases in safety, fuel and traffic efficiency, as well as through attendant passenger data recorder storage. AVs can also alter the legal landscape for vehicle manufacturers.

While vehicle EDRs (e.g., "black boxes" in vehicles), are not currently mandatory, over 90% of automobiles utilize some form of an EDR. For autonomous vehicles, it is likely that EDRs will be mandatory. The amount of data created by non-autonomous vehicles having at least some automated components and AVs can be very large, so that an EDR is not be able to store all the data locally for an extended period of time.

The advent of differing levels of automation in vehicles, from, for example, automatic braking systems and lane departure warnings to fully automated cars, will cause EDR technology to become broader in scope, and to likely figure more prominently in product liability cases. Automation creates more data points, including, but not necessarily limited to, data regarding characteristics of the vehicle (e.g., tire pressure, speed, airbag deployment, etc.), data concerning surroundings and the driver and/or passengers (e.g., the distance from and movements of other vehicles or pedestrians, weather conditions, the actions of the driver, whether the car was in automated mode, seatbelt usage, etc.).

AV manufacturers may be able to avoid liability in the event of an accident by using EDRs to show that the vehicle was operated properly prior to and during the accident. Embodiments of the present invention contemplate that as vehicle automation increases and progresses toward AVs, manufacturers will want to maintain accurate records of vehicle and driving conditions, which may explain accidents and help determine liability when accidents occur. Embodiments of the present invention provide a data management system for EDRs so that increasing amounts of valuable operating data beyond the airbag deployment information collected today can be recorded.

FIG. 1 shows an information processing system 100 configured in accordance with an illustrative embodiment. The information processing system 100 comprises vehicles 102-1, 102-2, . . . 102-N. The vehicles 102 communicate over a network 104 with a data recorder storage platform 105.

Figures 2, 3:
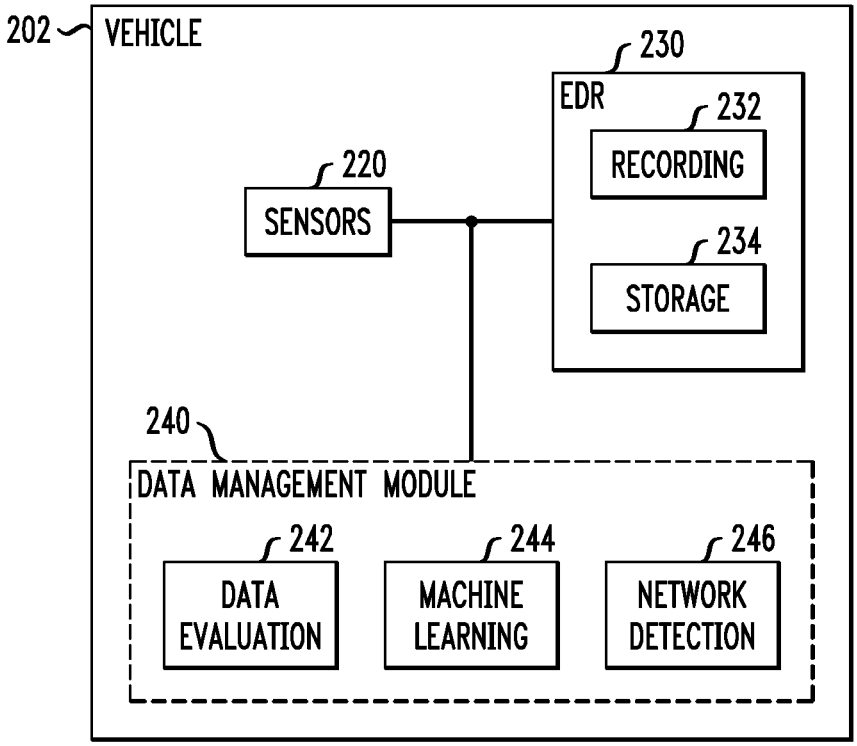
FIG. 2 is a block diagram of a vehicle comprising a data management module in an illustrative embodiment.
FIG. 3 illustrates a chart describing data valuation in an illustrative embodiment.

As described in more detail herein in connection with FIG. 2, the vehicles 102 can comprise, for example, sensors, an EDR and a data management module. The vehicles 102 are capable of communicating with the data recorder storage platform 105 over the network 104.

The variable N and other similar index variables herein such as K, L and M are assumed to be arbitrary positive integers greater than or equal to two.

Data recorder storage services are assumed to be provided for vehicles under one or more data recorder storage platforms, although it is to be appreciated that other types of infrastructure arrangements could be used. At least a portion of the available data recorder storage services in some embodiments may be provided under Function-as-a-Service ("FaaS") and/or Platform-as-a-Service (PaaS) models, including cloud-based FaaS and PaaS environments.

The data recorder storage platform 105 in the present embodiment is assumed to implement and provide data recorder storage and analytics which are accessible to the vehicles 102 over the network 104. The network 104 is assumed to comprise a portion of a global computer network such as the Internet, although other types of networks can be part of the network 104, including a wide area network (WAN), a local area network (LAN), a satellite network, a telephone or cable network, a cellular network, a wireless network such as a WiFi or WiMAX network, or various portions or combinations of these and other types of networks. The network 104 in some embodiments therefore comprises combinations of multiple different types of networks each comprising processing devices configured to communicate using IP, cellular or other related communication protocols.

As a more particular example, some embodiments may utilize one or more high-speed local networks in which associated processing devices communicate with one another utilizing Peripheral Component Interconnect express (PCIe) cards of those devices, and networking protocols such as InfiniBand, Gigabit Ethernet or Fibre Channel. Numerous alternative networking arrangements are possible in a given embodiment, as will be appreciated by those skilled in the art.

The term "user" herein is intended to be broadly construed so as to encompass numerous arrangements of human, hardware, software or firmware entities, as well as combinations of such entities. The data recorder storage platform 105 provides storage services for EDR data on behalf of respective infrastructure tenants each corresponding to one or more users associated with respective ones of the vehicles 102. According to an embodiment, the infrastructure tenants are cloud infrastructure tenants.

As noted herein, the amount of data created by non-autonomous vehicles having at least some automated components and AVs can be very large. As a result, an EDR which is part of a vehicle (e.g., an on-vehicle EDR) is not able to store all the collected EDR data locally, and local data needs to be periodically erased and/or overwritten. In accordance with an embodiment of the present invention, an EDR data management system that is part of a vehicle writes data synchronously to an on-vehicle EDR, and any data written to the on-vehicle EDR is replicated asynchronously over network 104 (e.g., a cellular network) to the data recorder storage platform 105. The data recorder storage platform 105 in some embodiments may be implemented as part of cloud infrastructure in the form of a cloud-based system such as an AWS system. Other examples of cloud-based systems that can be used to provide at least portions of the data recorder storage platform 105 and possibly other portions of system 100 include GCE and Windows Azure®. In accordance with an embodiment of the present invention, the data replicated to the data recorder storage platform 105 is marked by the vehicle EDR as data that can be deleted from the vehicle EDR.

The data recorder storage platform 105 in the embodiment of FIG. 1 illustratively comprises a data reception module 110, a data storage module 113 and an analytics module 115. In more detail, the data reception module 110 is configured to receive the EDR data from one or more vehicles 102 that is to be replicated. The data reception module 110 includes appropriate network interface circuitry for interfacing the data recorder storage platform 105 with the network 104 and may comprise one or more transceivers.

The data storage module 113 is configured to store the EDR data from the vehicles 102 that is to be replicated. In accordance with an embodiment of the present invention, the data storage module 113 includes a database service, such as, but not necessarily limited to GCE Cloud Storage, Microsoft Azure Blob (Binary Large Object) Storage, DynamoDB, MongoDB, Amazon Aurora and Oracle database.

Although the data storage module 113 in the present embodiment is shown as part of the data recorder storage platform 105, at least a portion of the data storage module 113 in other embodiments may be implemented on one or more other processing platforms that are accessible to the data recorder storage platform 105 over one or more networks.

In the FIG. 1 embodiment, the data storage module 113 is assumed to comprise one or more storage systems configured to store the vehicle EDR data, as well as information relating to processing performed and data used in the data reception and analytics modules 110 and 115, and relating to other functionality of the data recorder storage platform 105. Such storage systems can comprise any of a variety of different types of storage including network-attached storage (NAS), storage area networks (SANs), direct-attached storage (DAS) and distributed DAS, as well as combinations of these and other storage types, including software-defined storage.

Other particular types of storage products that can be used in implementing a given storage system of data recorder storage platform 105 in an illustrative embodiment include VNX® and Symmetrix VMAX® storage arrays, flash hybrid storage products such as Unity™, software-defined storage products such as ScaleIO™ and ViPR®, cloud storage products such as Elastic Cloud Storage (ECS), object-based storage products such as Atmos®, scale-out all-flash storage arrays such as XtremIO™, and scale-out NAS clusters comprising Isilon® platform nodes and associated accelerators, all from Dell EMC. Combinations of multiple ones of these and other storage products can also be used in implementing a given storage system in an illustrative embodiment.

The analytics module 115 analyzes the replicated vehicle EDR data stored in the data storage module 113 to determine, for example, accident causation, liability and/or contributing factors. The analytics module 115 can provide the results of the analysis to, for example, one or more user devices 106-1, 106-2, . . . 106-M (collectively referred to herein as user devices 106) over the network 104. The user devices 106 can comprise, for example, desktop, laptop or tablet computers, mobile telephones, or other types of processing devices capable of communicating with the data recorder services platform 105 over the network 104.

FIG. 2 is a block diagram of a vehicle comprising a data management module in an illustrative embodiment. Referring to FIG. 2, a vehicle 202, which can be any of vehicles 102 in FIG. 1, comprises a plurality of sensors 220, an EDR 230 comprising recording and storage components 232 and 234, and a data management module 240 comprising data evaluation, machine learning and network detection components 242, 244 and 246, respectively. According to an embodiment of the present invention, the sensors 220 include, but are not necessarily limited to, impact, air bag deployment, speed, engine RPM, braking, brake pressure, tire pressure, temperature, moisture/rain, seatbelt use, other vehicle, pedestrian, lane departure, acceleration, and/or surrounding object sensors, or other sensors used in connection with determining vehicle characteristics, environment and/or collisions. Data from the sensors 220 is written to the EDR 230 during operation of the vehicle 202 and/or before, during and after an event, such as an accident. In accordance with an embodiment of the present invention, some sensors 220 are video and light detection and ranging (Lidar) sensors capturing video and Lidar recordings of the areas surrounding a vehicle. Lidar sensors scan an environment with a pulsed laser beam and measure a reflection time of signals from the scanned objects back to the sensor. Lidar and video data occupy large amounts of storage space and require large memory capacities, and may use most or all of the available storage capacity in a storage component 234 of an EDR 230. Accordingly, by retaining at least the Lidar and video data in the data recorder storage platform 105, the Lidar and video data can be removed from a memory region of the EDR to create storage space for other data.

The EDR includes, for example, a recording component 232, which records the data received from the sensors 220. The recorded data is synchronously written onto a memory of the storage component 234. The data management module 240 includes a data evaluation component 242, which evaluates the value of the data recorded by the recording component 232 and written to the storage component 234. In accordance with an embodiment of the present invention, the data evaluation component 242 will cause the deletion of data from the storage component 234 which was already transmitted to and replicated in the data recorder storage platform 105.

In a situation where replication is prevented due to network connectivity from the vehicle 202 to the data recorder storage platform 105 being intermittent or unavailable, and free storage space being limited or not available on the storage component 234, the data evaluation component 242 determines the relative importance of EDR data. More specifically, the data evaluation component 242 determines which EDR data should be deleted or retained by the storage component 234 based on a determination of which data is more valuable. For example, for data that has not been replicated in the data recorder storage platform 105, data that has been determined by the data evaluation component 242 to have a lower valuation than other data in the storage component 234 is deleted before the other data. The deletion is performed to make room in the storage component 234 for additional more valuable data.

According to one or more embodiments of the present invention, the valuation can depend on the age of the data, for example, deleting older data (e.g., data with earlier timestamps) before newer data (e.g., data with later timestamps). In an example scenario, data which has been replicated in the data recorder storage platform 105 is deleted first, followed by non-replicated data which is older and/or less important than other newer and/or more important non-replicated data. The valuation of specific data may also change due to one or more events. For example, if the data management module 240 determines or receives an input indicating that the braking system of the vehicle 202 is malfunctioning, the data evaluation component 242 determines that historical information, and information going forward about the brakes (at least until the braking system stops malfunctioning) is more important than other data.

In another example, conventional systems are reactive to the occurrence of an event, such as an airbag deployment, and save data recorded immediately before and after the event. The embodiments of the present invention, which can also be reactive, are also proactive, in that the data management module 240 attempts to predict the occurrence of an event before the event happens based on context. In a non-limiting illustrative example, based on certain conditions, such as but not necessarily limited to sensed weather conditions (e.g., snow, ice, rain, etc.), low tire pressure and high speed recorded by the sensors 220, a data management algorithm running in the data evaluation component 242 may change what data it values highest and alter a data management plan. For example, in connection with the illustrated example, the data management module may determine that there is a high risk of the occurrence of an accident due to high speed and poor weather and tire conditions, and assign the weather, tire pressure and speed data being recorded during a particular time period a high or critical value so that the weather, tire pressure and speed data is maintained over other data that may be deleted. As a result, relative to a reactive system, a higher volume of relevant data over a larger time period prior to the occurrence of an event can be maintained for analysis in the event of a subsequent accident.

According to an embodiment of the present invention, the data management module includes a machine learning component 244. The machine learning component 244 uses a unique combination of machine learning algorithms to learn which conditions lead to problematic occurrences, and assigns higher values to the learned conditions. In more detail, the machine learning component 244 uses recorded historical environmental and vehicle operating data to reach conclusions regarding which conditions led to problematic occurrences, such as, but not necessarily limited to, accidents, quick stoppages ("stopping short"), quick decelerations, swerving, and/or issuance of automatic system warnings, such as lane departure or being too close to an object. The determinations made by the machine learning component 244 are used by the data evaluation component 242 in connection with valuation and selection of appropriate data to maintain or delete given varied circumstances and data combinations. For example, the data management module 240 learns that individual or groups of conditions (e.g., high speed and poor weather and tire conditions noted above) resulted in certain problematic events. Accordingly, when the data management module 240 encounters these conditions or combinations of conditions again, the data management module 240 knows to rate these conditions and their associated data higher than other less critical conditions so that the higher rated data is maintained. In general, machine learning techniques and components used in accordance with embodiments of the present invention may include, but are not necessarily limited to, a Support Vector Machine (SVM), a Multilayer Perceptron (MLP), a deep learning model, decision trees, clustering and a neural network.

The data management module 240 includes a network detection component 246 to determine whether there is an available network connection that can be maintained to transfer EDR data from the EDR 230 to the data recorder storage platform 105 for replication and long term storage. If there is an available network connection that can be maintained to transfer the data, part of the EDR 230 (e.g., part of storage component 234) can serve as a buffer for the remote replication of less important data. Alternatively, when network connectivity is not available, the data that would have been transferred is valued relatively low, and may be deleted in favor of data determined to be more valuable, and will not be able to evict other more valuable data from the storage component 234. In addition, in accordance with an embodiment of the present invention, the data management module 240 can make a determination to transfer data determined to be of relatively higher value (e.g., critical data) to the data recorder storage platform 105 for replication before data determined to be less valuable.

In accordance with an embodiment of the present invention, as an alternative to deleting data, the data management module 240 transforms at least some of the data in a memory region (e.g., storage component 234) in the EDR 230 by reducing the resolution of data. For example, in order to save or preserve storage space and to create storage space for other data, video resolution and/or other sensor resolution, including, but not necessarily limited to, image and Lidar data resolution, can be reduced. In accordance with an embodiment of the present invention, the reduction is performed by keeping only a limited number or portions of samples of the data or generating and maintaining an average of a plurality of samples instead of keeping entire samples and/or all samples of the data.

FIG. 3 illustrates a chart describing data valuation in an illustrative embodiment. Referring to FIG. 3, the chart 300 includes a first column 301 corresponding to the time the data was created, a second column 303 corresponding to the determined importance of the data, and a third column 305 describing whether the data was replicated at the data recorder storage platform 105. The numbers in the first column 301 may, for example, correspond to different timestamps indicating different times and/or dates that the data was created. The second column 303 includes varying indications of the importance of the data. In this case, "critical data" represents data determined to be the most valuable, "nice to have data" represents data determined to be the least important, and "important data" has a value between "critical" and "nice to have" data. The embodiments of the present invention are not limited to indications of the value of the data shown in FIG. 3, and may include various scales (e.g., numerical scales, color scales, word scales, etc.) for indicating different degrees of value. The third column 305 includes some form of indication whether the data in a particular row was remotely replicated. In a non-limiting operational example, it is assumed that three instances of data have been created, and the data evaluation component 242 has determined that each of the three instances have the lowest value (e.g., "nice to have"). According to an embodiment, the newest instance of the "nice to have" data can replace the data corresponding to timestamp 8 since it is newer, and the remaining two instances of the "nice to have" data may be discarded, since all the remaining data as shown on the chart 300 have not yet been remotely replicated and are rates as more important.

In general, data valuation can be based on a variety of learned and/or programmed factors. For example, as discussed herein, older data may be valued lower than newer data. Also, as discussed herein, machine learning algorithms are used to determine which types of data and/or which data combinations (e.g., multiple factors, such as weather combined with vehicle malfunctions) contribute more to problematic events than other types of data and/or data combinations. As referenced herein above, data valuation can correspond to a predetermined scale representing different data importance values. The assignment of a particular data instance to a level on the scale is based on the learned and/or programmed factors. The assignment of a particular data instance to a level on the scale can also be based on predetermined thresholds, such as speed data exceeding a given amount (e.g., very high speed being critical), tire pressure being at dangerously low levels, sensed high volume of rain, sensed frequency of lane departure warnings (indicating, e.g., lack of vehicle control and/or multiple obstacles), etc.

It is assumed that the data recorder storage platform 105 in the FIG. 1 embodiment and other processing platforms referred to herein are each implemented using a plurality of processing devices each having a processor coupled to a memory. Such processing devices can illustratively include particular arrangements of compute, storage and network resources. For example, processing devices in some embodiments are implemented at least in part utilizing virtual resources such as virtual machines (VMs) or Linux containers (LXCs), or combinations of both as in an arrangement in which Docker containers or other types of LXCs are configured to run on VMs.

The term "processing platform" as used herein is intended to be broadly construed so as to encompass, by way of illustration and without limitation, multiple sets of processing devices and one or more associated storage systems that are configured to communicate over one or more networks.

As a more particular example, the data reception, data storage and analytics components 110, 113 and 115 and the elements thereof can each be implemented in the form of one or more LXCs running on one or more VMs. Other arrangements of one or more processing devices of a processing platform can be used to implement the data reception, data storage and analytics components 110, 113 and 115 as well as other components of the data recorder storage platform 105. Other portions of the system 100 can similarly be implemented using one or more processing devices of at least one processing platform.

Distributed implementations of the system 100 are possible, in which certain components of the system reside in one data center in a first geographic location while other components of the system reside in one or more other data centers in one or more other geographic locations that are potentially remote from the first geographic location. Thus, it is possible in some implementations of the system 100 for different portions of the data recorder storage platform 105 to reside in different data centers. Numerous other distributed implementations of the data recorder storage platform 105 are possible.

Accordingly, one or each of the data reception, data storage and analytics components 110, 113 and 115 can each be implemented in a distributed manner so as to comprise a plurality of distributed components implemented on respective ones of the plurality of compute nodes of the data recorder storage platform 105.

Although illustratively shown as being implemented within the data recorder storage platform 105, the data reception, data storage and analytics components 110, 113 and 115 and the elements thereof in other embodiments can be implemented at least in part externally to the data recorder storage platform 105. For example, such components can each be implemented at least in part within another system element or at least in part utilizing one or more stand-alone components coupled to the network 104.

It is to be appreciated that these and other features of illustrative embodiments are presented by way of example only, and should not be construed as limiting in any way.

Accordingly, different numbers, types and arrangements of system components such as the vehicles 102, user devices 106, and the data recorder storage platform 105 and the elements thereof can be used in other embodiments.

It should be understood that the particular sets of modules and other components implemented in the system 100 as illustrated in FIG. 1 are presented by way of example only. In other embodiments, only subsets of these components, or additional or alternative sets of components, may be used, and such components may exhibit alternative functionality and configurations.

For example, as indicated previously, in some illustrative embodiments functionality for the data recorder storage platform 105 can be offered to cloud infrastructure customers or other users as part of FaaS and/or PaaS offerings.

The operation of the information processing system 100 will now be described in further detail with reference to the flow diagram of FIG. 4. The process as shown includes steps 401 through 403, and is suitable for use in the system 100 but is more generally applicable to other types of information processing systems comprising data management systems and data recorder storage platforms configured to make management decisions concerning EDR data and remotely replicate EDR data.

In step 401, in an information processing system comprising at least one vehicle wherein the at least one vehicle comprises an event data recorder and a data management module resident in the at least one vehicle, a plurality of data elements are recorded in the event data recorder.

In step 403, each of the plurality of data elements is evaluated, for example, using a data evaluation component 242 of the data management module 240, to determine which of the plurality of data elements to maintain in a memory region (e.g., storage component 234) of the event data recorder and which of the plurality of data elements to delete from the memory region of the event data recorder. The plurality of data elements may comprise an operational feature of the vehicle (e.g., speed, airbag deployment, brake application, issued warning, etc.), a condition of a component of the vehicle (e.g., tire pressure, vehicle temperature, seatbelt usage, component malfunction, etc.) and an environmental condition around the vehicle (e.g., weather conditions, light/darkness, visibility, poor road conditions, etc.). One or more of the plurality of data elements are derived from data gathered by a sensor on the vehicle.

In accordance with an embodiment of the present invention, the evaluating comprises assigning a value to each of the plurality of data elements. The value of a data element is based on whether the data element has been determined to at least contribute to a vehicle event (e.g., an accident) that may occur. An accident can include, but is not necessarily limited to, a collision with another vehicle, object or pedestrian, and/or a loss of control of the vehicle causing the vehicle to become compromised (e.g., flip, skid, turn in a wrong direction), exit the roadway, and/or collide with another vehicle, object or pedestrian. Assigning of the value and/or determining whether a data element at least contributes to a vehicle event can be performed using one or more machine learning algorithms.

In accordance with an embodiment of the present invention, one or more data elements of the plurality of data elements assigned a lower value than other data elements of the plurality of data elements is deleted from the memory region of the event data recorder.

The evaluating can also include determining when a data element of the plurality of data elements was created relative to other data elements of the plurality of data elements, wherein earlier created data elements are deleted before later created data elements.

One or more of the plurality of data elements are replicated in a storage platform (e.g., data recorder storage platform 105) connected to the vehicle over one or more networks (e.g., network 104). Data elements that have been replicated in the storage platform can be selected for deletion and deleted from the memory region of the event data recorder since a copy exists on the storage platform. Data elements that have not been replicated in the storage platform can be selected to be maintained in the memory region of the event data recorder since a copy of these data elements does not exist on the storage platform. In accordance with an embodiment of the present invention, the storage platform is a cloud-based storage platform.

The data management module may predict whether a vehicle event will occur due to one or more of the plurality of data elements. For example, given recorded data corresponding to problems with a vehicle and poor environmental conditions simultaneously occurring, the data management module 240 may predict that an accident will occur based on the recorded data. As a result, the data management module 240 may assign a higher value to one or more of these recorded data elements, so that these data elements are maintained in favor of other data elements in case there is an accident, and analysis is required of these recorded data elements. In accordance with an embodiment of the present invention, a resolution of one or more of the plurality of data elements in a memory region of the EDR is reduced in order to create more available storage space in the memory region.

Figure 4:
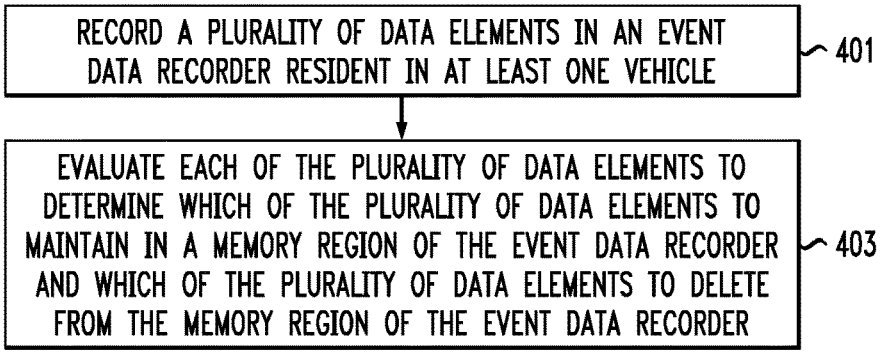
FIG. 4 is a flow diagram of a process utilizing a data management module in an illustrative embodiment.

It is to be appreciated that the FIG. 4 process and other features and functionality described above can be adapted for use with other types of information systems configured to make management decisions concerning EDR data and remotely replicate EDR data on a data recorder storage platform or other type of processing platform.

The particular processing operations and other system functionality described in conjunction with the flow diagram of FIG. 4 are therefore presented by way of illustrative example only, and should not be construed as limiting the scope of the disclosure in any way. Alternative embodiments can use other types of processing operations. For example, the ordering of the process steps may be varied in other embodiments, or certain steps may be performed at least in part concurrently with one another rather than serially. Also, one or more of the process steps may be repeated periodically, or multiple instances of the process can be performed in parallel with one another.

Functionality such as that described in conjunction with the flow diagram of FIG. 4 can be implemented at least in part in the form of one or more software programs stored in memory and executed by a processor of a processing device such as a computer or server. As will be described below, a memory or other storage device having executable program code of one or more software programs embodied therein is an example of what is more generally referred to herein as a "processor-readable storage medium."

Illustrative embodiments of EDR data management systems and a data recorder storage platform as disclosed herein can provide a number of significant advantages relative to conventional arrangements. For example, on-vehicle EDR storage has limited capacity, so that not all recorded data can be stored in the EDR. In conventional systems, in order to address the limited capacity issues, the data that is recorded is arbitrarily deleted to make room for additional data, or is limited as in, for example, the case of airbag deployment where a simple management algorithm will just store the data seconds before and after airbag deployment. The embodiments of the present invention advantageously provide intelligent decision-making on what data to keep in EDR storage, basing storage decisions on a determined value/importance of the data and whether the data is related to or will contribute to vehicle accidents. Accordingly, data management decisions in embodiments of the present invention are based on whether the data is associated with some form of risk to the vehicle. Embodiments of the present invention prioritize data associated with that risk so that the prioritized data is maintained.

EDR data storage in conventional systems is reactive to an event such as an accident, performing no evaluation of the data to be stored or maintained. As an improvement to conventional systems, the embodiments of the present invention advantageously provide context-based and risk-based data management taking the subject of the data and its relation to vehicle operation into account when determining whether to maintain or delete the data.

Embodiments of the present invention further advantageously take advantage of networking capabilities of vehicles connected to a network, to provide remote storage and/or replication capabilities of EDR data at a remote storage platform. Accordingly, embodiments of the present invention manage data based on whether or not data was sent to an external platform over a network, and can create copies of data through a networked service. Then decisions can be made to delete backed-up data, while maintaining data that has not yet been replicated.

Accordingly, unlike in traditional EDRs, where no distinctions are made between different data types or based on whether data has been replicated, the embodiments of the present invention advantageously provide a data management system that accounts for different data types and their effect on vehicle events, as well as a system which remotely replicates the EDR data and manages the data based on whether replication has occurred.

It is to be appreciated that the particular advantages described above and elsewhere herein are associated with particular illustrative embodiments and need not be present in other embodiments. Also, the particular types of information processing system features and functionality as illustrated in the drawings and described above are exemplary only, and numerous other arrangements may be used in other embodiments.

As noted above, at least portions of the information processing system 100 may be implemented using one or more processing platforms. A given such processing platform comprises at least one processing device comprising a processor coupled to a memory. The processor and memory in some embodiments comprise respective processor and memory elements of a virtual machine or container provided using one or more underlying physical machines. The term "processing device" as used herein is intended to be broadly construed so as to encompass a wide variety of different arrangements of physical processors, memories and other device components as well as virtual instances of such components. For example, a "processing device" in some embodiments can comprise or be executed across one or more virtual processors. Processing devices can therefore be physical or virtual and can be executed across one or more physical or virtual processors. It should also be noted that a given virtual device can be mapped to a portion of a physical one.

Some illustrative embodiments of a processing platform that may be used to implement at least a portion of an information processing system comprise cloud infrastructure including virtual machines implemented using a hypervisor that runs on physical infrastructure. The cloud infrastructure further comprises sets of applications running on respective ones of the virtual machines under the control of the hypervisor. It is also possible to use multiple hypervisors each providing a set of virtual machines using at least one underlying physical machine. Different sets of virtual machines provided by one or more hypervisors may be utilized in configuring multiple instances of various components of the system.

These and other types of cloud infrastructure can be used to provide what is also referred to herein as a multi-tenant environment. One or more system components such as the data recorder storage platform 105 or portions thereof are illustratively implemented for use by tenants of such a multi-tenant environment.

As mentioned previously, cloud infrastructure as disclosed herein can include cloud-based systems such as AWS, GCE and Windows Azure. Virtual machines provided in such systems can be used to implement at least portions of one or more of a computer system and a content addressable storage system in illustrative embodiments. These and other cloud-based systems in illustrative embodiments can include object stores such as AWS S3, GCE Cloud Storage, and Microsoft Azure Blob Storage.

In some embodiments, the cloud infrastructure additionally or alternatively comprises a plurality of containers implemented using container host devices. For example, a given container of cloud infrastructure illustratively comprises a Docker container or other type of LXC. The containers may run on virtual machines in a multi-tenant environment, although other arrangements are possible. The containers may be utilized to implement a variety of different types of functionality within the system 100. For example, containers can be used to implement respective processing devices providing data recorder storage of a cloud-based system. Again, containers may be used in combination with other virtualization infrastructure such as virtual machines implemented using a hypervisor.

Illustrative embodiments of processing platforms will now be described in greater detail with reference to FIGS. 5 and 6. Although described in the context of system 100, these platforms may also be used to implement at least portions of other information processing systems in other embodiments.

Figure 5:
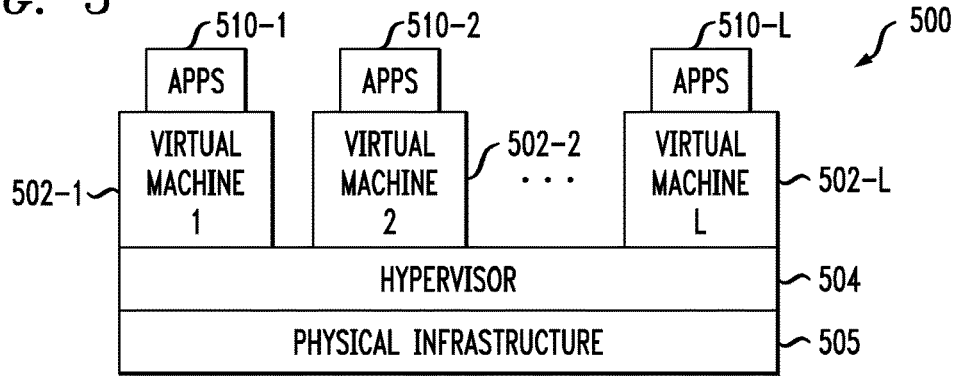
FIGS. 5 and 6 show examples of processing platforms that may be utilized to implement at least a portion of an information processing system in illustrative embodiments.
Figure 6:
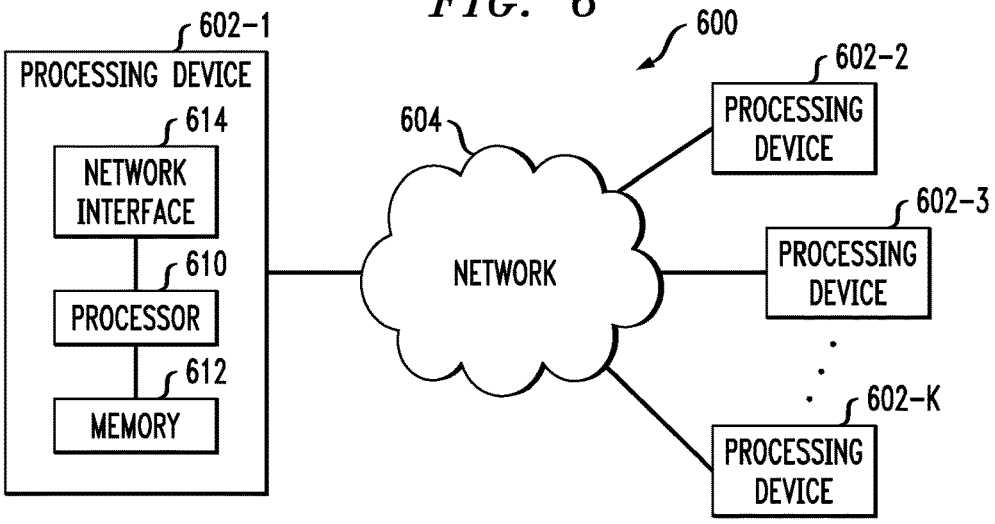

FIG. 5 shows an example processing platform comprising cloud infrastructure 500. The cloud infrastructure 500 comprises a combination of physical and virtual processing resources that may be utilized to implement at least a portion of the information processing system 100. The cloud infrastructure 500 comprises virtual machines (VMs) 502-1, 502-2, . . . 502-L implemented using a hypervisor 504. The hypervisor 504 runs on physical infrastructure 505. The cloud infrastructure 500 further comprises sets of applications 510-1, 510-2, . . . 510-L running on respective ones of the virtual machines 502-1, 502-2, . . . 502-L under the control of the hypervisor 504.

Although only a single hypervisor 504 is shown in the embodiment of FIG. 5, the system 100 may of course include multiple hypervisors each providing a set of virtual machines using at least one underlying physical machine. Different sets of virtual machines provided by one or more hypervisors may be utilized in configuring multiple instances of various components of the system 100.

An example of a commercially available hypervisor platform that may be used to implement hypervisor 504 and possibly other portions of the information processing system 100 in one or more embodiments is the VMware® vSphere® which may have an associated virtual infrastructure management system such as the VMware® vCenter™. The underlying physical machines may comprise one or more distributed processing platforms that include one or more storage systems.

As is apparent from the above, one or more of the processing modules or other components of system 100 may each run on a computer, server, storage device or other processing platform element. A given such element may be viewed as an example of what is more generally referred to herein as a "processing device." The cloud infrastructure 500 shown in FIG. 5 may represent at least a portion of one processing platform. Another example of such a processing platform is processing platform 600 shown in FIG. 6.

The processing platform 600 in this embodiment comprises a portion of system 100 and includes a plurality of processing devices, denoted 602-1, 602-2, 602-3, . . . 602-K, which communicate with one another over a network 604.

The network 604 may comprise any type of network, including by way of example a global computer network such as the Internet, a WAN, a LAN, a satellite network, a telephone or cable network, a cellular network, a wireless network such as a WiFi or WiMAX network, or various portions or combinations of these and other types of networks.

The processing device 602-1 in the processing platform 600 comprises a processor 610 coupled to a memory 612.

The processor 610 may comprise a microprocessor, a microcontroller, an application-specific integrated circuit (ASIC), a field-programmable gate array (FPGA) or other type of processing circuitry, as well as portions or combinations of such circuitry elements.

The memory 612 may comprise random access memory (RAM), read-only memory (ROM) or other types of memory, in any combination. The memory 612 and other memories disclosed herein should be viewed as illustrative examples of what are more generally referred to as "processor-readable storage media" storing executable program code of one or more software programs.

Articles of manufacture comprising such processor-readable storage media are considered illustrative embodiments. A given such article of manufacture may comprise, for example, a storage array, a storage disk or an integrated circuit containing RAM, ROM or other electronic memory, or any of a wide variety of other types of computer program products. The term "article of manufacture" as used herein should be understood to exclude transitory, propagating signals. Numerous other types of computer program products comprising processor-readable storage media can be used.

Also included in the processing device 602-1 is network interface circuitry 614, which is used to interface the processing device with the network 604 and other system components, and may comprise conventional transceivers.

The other processing devices 602 of the processing platform 600 are assumed to be configured in a manner similar to that shown for processing device 602-1 in the figure.

Again, the particular processing platform 600 shown in the figure is presented by way of example only, and system 100 may include additional or alternative processing platforms, as well as numerous distinct processing platforms in any combination, with each such platform comprising one or more computers, servers, storage devices or other processing devices.

For example, other processing platforms used to implement illustrative embodiments can comprise different types of virtualization infrastructure, in place of or in addition to virtualization infrastructure comprising virtual machines. Such virtualization infrastructure illustratively includes container-based virtualization infrastructure configured to provide Docker containers or other types of LXCs.

As another example, portions of a given processing platform in some embodiments can comprise converged infrastructure such as VxRail™, VxRack™, VxRack™ FLEX, VxBlock™, or Vblock® converged infrastructure from VCE, the Virtual Computing Environment Company, now the Converged Platform and Solutions Division of Dell EMC.

It should therefore be understood that in other embodiments different arrangements of additional or alternative elements may be used. At least a subset of these elements may be collectively implemented on a common processing platform, or each such element may be implemented on a separate processing platform.

Also, numerous other arrangements of computers, servers, storage devices or other components are possible in the information processing system 100. Such components can communicate with other elements of the information processing system 100 over any type of network or other communication media.

As indicated previously, components of an information processing system as disclosed herein can be implemented at least in part in the form of one or more software programs stored in memory and executed by a processor of a processing device. For example, at least portions of the functionality of one or more components of the data recorder storage platform 105 and/or one or more components of the sensors 220, EDR 230 and data management module 240 are illustratively implemented in the form of software running on one or more processing devices.

It should again be emphasized that the above-described embodiments are presented for purposes of illustration only. Many variations and other alternative embodiments may be used. For example, the disclosed techniques are applicable to a wide variety of other types of information processing systems and data recorder storage platforms. Also, the particular configurations of system and device elements and associated processing operations illustratively shown in the drawings can be varied in other embodiments. Moreover, the various assumptions made above in the course of describing the illustrative embodiments should also be viewed as exemplary rather than as requirements or limitations of the disclosure. Numerous other alternative embodiments within the scope of the appended claims will be readily apparent to those skilled in the art.

What is claimed is:

1. A method comprising:

in an information processing system comprising one or more vehicles, wherein a given vehicle of the one or more vehicles comprises an event data recorder and a data management module resident in the given vehicle, recording a plurality of data elements in the event data recorder;

detecting whether a communications network is available for transmission of the plurality of data elements to a storage platform remote from the given vehicle;

detecting that the communications network is unavailable for the transmission of the plurality of data elements;

evaluating each of the plurality of data elements to determine which of the plurality of data elements to maintain in a memory region of the event data recorder and which of the plurality of data elements to delete from the memory region of the event data recorder responsive to the detection of the unavailability of the communications network;

using one or more machine learning algorithms to learn one or more conditions leading to one or more vehicle events;

identifying an occurrence of the one or more conditions, wherein one or more of the plurality of data elements recorded in the event data recorder correspond to the one or more conditions; and predicting an occurrence of a vehicle event of the one or more vehicle events due to the occurrence of the one or more conditions;

wherein the evaluating comprises assigning a higher maintenance value to the one or more of the plurality of data elements corresponding to the one or more conditions than to remaining data elements of the plurality of data elements responsive to the predicting.

2. The method of claim 1, wherein the vehicle event comprises an accident.

3. The method of claim 1, wherein the assigning of the higher maintenance value is performed using the one or more machine learning algorithms.

4. The method of claim 1, further comprising deleting one or more of the remaining data elements of the plurality of data elements assigned a lower maintenance value than the one or more of the plurality of data elements corresponding to the one or more conditions.

5. The method of claim 1, wherein the evaluating further comprises determining when a data element of the plurality of data elements was created relative to other data elements of the plurality of data elements.

6. The method of claim 5, further comprising deleting the data element if the data element was created earlier than the other data elements.

7. The method of claim 1, wherein the plurality of data elements comprise at least one of an operational feature of the vehicle, a condition of a component of the vehicle and an environmental condition around the vehicle.

8. The method of claim 7, wherein the one or more of the plurality of data elements are derived from a sensor on the vehicle.

9. The method of claim 1, further comprising:

detecting that the communications network is available;

transmitting the one or more of the plurality of data elements corresponding to the one or more conditions to the storage platform over the communications network; and replicating the one or more of the plurality of data elements in the storage platform.

10. The method of claim 9, further comprising deleting the replicated one or more of the plurality of data elements from the memory region of the event data recorder.

11. The method of claim 10, further comprising maintaining in the memory region of the event data recorder the plurality of data elements which have not been replicated.

12. The method of claim 1, further comprising reducing a resolution of the one or more of the plurality of data elements.

13. An apparatus comprising:

in an information processing system comprising one or more vehicles, wherein a given vehicle of the one or more vehicles comprises an event data recorder and a data management module resident in the given vehicle;

at least one processor configured to:

record a plurality of data elements in the event data recorder detect whether a communications network is available for transmission of the plurality of data elements to a storage platform remote from the given vehicle;

detect that the communications network is unavailable for the transmission of the plurality of data elements;

evaluate each of the plurality of data elements to determine which of the plurality of data elements to maintain in a memory region of the event data recorder and which of the plurality of data elements to delete from the memory region of the event data recorder responsive to the detection of the unavailability of the communications network;

use one or more machine learning algorithms to learn one or more conditions leading to one or more vehicle events;

identify an occurrence of the one or more conditions, wherein one or more of the plurality of data elements recorded in the event data recorder correspond to the one or more conditions; and predict an occurrence of a vehicle event of the one or more vehicle events due to the occurrence of the one or more conditions;

wherein, in evaluating each of the plurality of data elements, the at least one processor is further configured to assign a higher maintenance value to the one or more of the plurality of data elements corresponding to the one or more conditions than to remaining data elements of the plurality of data elements responsive to the predicting.

14. The apparatus of claim 13, wherein the at least one processor is further configured to delete one or more of the remaining data elements of the plurality of data elements assigned a lower maintenance value than the one or more of the plurality of data elements corresponding to the one or more conditions.

15. An article of manufacture comprising a non-transitory processor-readable storage medium having stored therein program code of one or more software programs, wherein the program code when executed by at least one processor causes said at least one processor to:

in an information processing system comprising one or more vehicles, wherein a given vehicle of the one or more vehicles comprises an event data recorder and a data management module resident in the given vehicle, record a plurality of data elements in the event data recorder detect whether a communications network is available for transmission of the plurality of data elements to a storage platform remote from the given vehicle;

detect that the communications network is unavailable for the transmission of the plurality of data elements;

evaluate each of the plurality of data elements to determine which of the plurality of data elements to maintain in a memory region of the event data recorder and which of the plurality of data elements to delete from the memory region of the event data recorder responsive to the detection of the unavailability of the communications network;

use one or more machine learning algorithms to learn one or more conditions leading to one or more vehicle events;

identify an occurrence of the one or more conditions, wherein one or more of the plurality of data elements recorded in the event data recorder correspond to the one or more conditions; and predict an occurrence of a vehicle event of the one or more vehicle events due to the occurrence of the one or more conditions;

wherein, in evaluating each of the plurality of data elements, the program code further causes said at least one processor to assign a higher maintenance value to the one or more of the plurality of data elements corresponding to the one or more conditions than to remaining data elements of the plurality of data elements responsive to the predicting.

16. The article of manufacture of claim 15, wherein the program code further causes said at least one processor to delete one or more of the remaining data elements of the plurality of data elements assigned a lower maintenance value than the one or more of the plurality of data elements corresponding to the one or more conditions.

17. The article of manufacture of claim 15, wherein, in evaluating each of the plurality of data elements, the program code further causes said at least one processor to determine when a data element of the plurality of data elements was created relative to other data elements of the plurality of data elements.

18. The article of manufacture of claim 17, wherein the program code further causes said at least one processor to delete the data element if the data element was created earlier than the other data elements.

19. The article of manufacture of claim 15, wherein the program code further causes said at least one processor to:

detect that the communications network is available;

transmit the one or more of the plurality of data elements corresponding to the one or more conditions to the storage platform over the communications network; and replicate the one or more of the plurality of data elements in the storage platform.

20. The article of manufacture of claim 19, wherein the program code further causes said at least one processor to delete the replicated one or more of the plurality of data elements from the memory region of the event data recorder.

* * * * *